United States Patent [19]

Lee

[11] 4,088,452

[45] May 9, 1978

[54] PREFUEL COMPOSITION AND METHOD

[75] Inventor: Soo B. Lee, Seoul, South Korea

[73] Assignee: Ki Hyun Lee, Los Angeles, Calif.

[21] Appl. No.: 654,015

[22] Filed: Jan. 30, 1976

[51] Int. Cl.[2] ..... C10L 1/32

[52] U.S. Cl. ..... 44/51

[58] Field of Search ..... 44/51, 50; 208/370

[56] References Cited

U.S. PATENT DOCUMENTS 1,431,225 10/1922 Greenstreet ..... 44/51

*Primary Examiner*—Daniel E. Wyman

*Assistant Examiner*—Mrs. Y. Harris-Smith

*Attorney, Agent, or Firm*—Poms, Smith, Lande & Glenny

[57] ABSTRACT

A prefuel composition which can be used as a fuel and which is easily mixed with water and when mixed with water and petroleum oil is an excellent fuel. A method for making such a prefuel composition which includes the steps of forming a non-homogenous mixture of carbon, water and petroleum oil and heating said mixture for a period of time and separating the resulting liquid from the solid in the mixture and burning said liquid in the presence of air for a period of time and then removing the source of air to extinguish the flame. There is also described a fuel composition which includes a solution of the preferred composition, water and petroleum oil.

5 Claims, No Drawings

PREFUEL COMPOSITION AND METHOD

BACKGROUND OF THE INVENTION

In the past few decades as our society has grown more and more complex the use of natural resources, and particularly fossil fuels such as petroleum, has increased to the point where there are shortages of such natural resources and the expense of such natural resources has, to some extent, made the use thereof prohibitive. This is particularly true in the area of fossil fuel which is used not only in internal combustion engines but also as means of heat for homes and businesses and, additionally, for heating boilers to generate electricity and the like. It is therefore desirable to develop means and methods for increasing the energy produced from fossil fuel and, particularly, petroleum products. One manner of doing this would be to be able to utilize, in conjunction with petroleum oil, a resource which is available in an almost exhaustive supply and which is inexpensive and which, when added to the petroleum oil, would increase the amount of energy available from such oil on a weight basis.

In view of the foregoing it is not surprising that it is heretofore been proposed to mix water with gasoline and/or oil. However, water is not mixable with oil or gasoline and therefore there is difficulty in forming a homogenous mixture but, more importantly, if relatively large amounts of water are mixed with the oil the energy produced by the oil is reduced proportionately.

SUMMARY OF THE INVENTION

The present invention relates to a process for producing a prefuel composition which may be used as a fuel per se but has a more important property, namely when it is used in combination with petroleum oil and water the petroleum oil and water form a one-phase intimate admixture which is useful for producing energy by burning, for example, to produce steam to generate electricity and the like.

The prefuel composition of the present invention is made, in general, as follows: oil, having a specific gravity of less than 1, water and carbon are placed in a heating zone open to the atmosphere. The two liquids, i.e. the oil and water, form two phases, with the oil lying on top of the water. The carbon, which is preferably coke, is placed so that it contacts both the oil and water phase and is, in general, placed and present in such amounts that it is uniformly mixed throughout the two phases. The non-homogenous mixture is then heated to such a temperature that the water vaporizes (e.g. from 50° or 70° to 100° C.). The vaporized water bubbles through the oil as well as contacting the carbon. This heating continues for a period of time in the heating zone, which is open to the atmosphere to allow the vaporized water and any other vapors produced by the heating, to leave the heating zone and enter the ambient atmosphere. The heating is continued until sunstantially all of the water is removed and there remains a one-phase liquid and the solid carbon. The heating, at this point, is then discontinued and there is then mixed with the remaining liquid and carbon a light oil such as kerosene or the like. The liquid mixture is then separated from the solid and is then ignited in another vessel open to the atmosphere. After a period of time, the flame is extinguished by closing the opening to the atmosphere thereby depriving the combustion reaction of oxygen. The liquid remaining from such periodic ignition and extinguishment is the prefuel composition of the present invention which can be used as a fuel per se but is of greater value in forming a fuel composed of a uniform mixture of the prefuel composition, water and an oil.

In order to more fully understand the present invention, presently preferred exemplary embodiments will be illustrated in which all parts and percentages are by weight unless expressly stated otherwise.

DESCRIPTION OF THE PREFERRED EMBODIMENTS

For brevity, the initial composition of this invention which is useful as a fuel per se but is more useful as an ingredient to make a fuel having almost the equivalent energy, on a weight basis, as oil is referred to as the prefuel composition. In the process of the present invention such prefuel composition is produced by placing carbon, water and petroleum oil (having a specific gravity of less than one) into a heating zone or retort which is open to the atmosphere. The carbon may be in any form such as coal, lampblack, charcoal, and the like, but is preferably coke because coke is relatively porous and yet is not in finely divided form thereby making it relatively easy to separate the liquid from the solid (coke). As is known in the art, coke is produced, in general, by distilling coal by heating without contact with air and is primarily composed of carbon with minor amounts of hydrogen, oxygen, etc. also being present. As noted, the prime reason that coke is the preferred source of carbon in the present invention is because it is not finely divided (as for example lampblack) and is relatively porous and therefore preferred over coal.

The oil used in making the prefuel composition of the present invention may also be any kind of oil having a specific gravity of less than one although petroleum oil is preferred. Included within this definition are the higher boiling products such as kerosene as well as the lower boiling products such as the fuel oils. Any of these oils may be utilized but it is presently preferred to use Bunker C. oil which is a heavy residual oil used, for example, as fuel by ships, industry and large scale heating installations.

In the preferred exemplary embodiment, the coke, water, and Bunker C. oil are all placed in a steel cyllindrical container having a discharge outlet at the bottom of the container, the top of the container being open to the atmosphere. The reason it is necessary to have an opening to the atmosphere is to allow the vapors (particularly water vapor) produced in the process to escape. Thus, a steel container with a one-way valve would be equally suited in the process of the present invention as an open steel container.

The various amounts of water, oil and carbon (coke in this instance) are not particularly critical and may range as follows: water from 10 percent to 50 percent, by weight; coke from 10 percent to 50 percent, by weight; and oil from 10 percent to 50 percent, by weight. All weights are based on the entire weight of the composition. In a preferred exemplary embodiment, the amounts are approximately 40 percent water, 30 percent coke, and 30 percent oil which are placed in a cyllindrical steel container in which the water is on the bottom and a layer of Bunker C. oil lays on top of the water, the solid coke being in contact with both the water and Bunker C. oil. This non-homogenous mixture is then heated, at the bottom, to a temperature of 70° to 100° C. (in the preferred exemplary embodiment approximately 90° C.) whereby the water vaporizes and bubbles through the Bunker C. oil and mixes therewith as well as the coke. In order to allow the vapors to escape, the cyllindrical steel tank is open to the atmosphere. During the heating, the water and oil expand and heating is continued until substantially all of the water is removed. The length of heating is not particularly critical but is preferably conducted until substantially all of the water is vaporized and has bubbled through the Bunker C. oil and escpaed to the atmosphere. I have found that a prefuel composition is satisfactory even if some of the water remains, for example, 30 percent or less of the water may remain in the composition. Alternatively, heating can continue even after the water is removed. However, this is uneconomical since the prefuel composition will then be driven off and wasted.

In the preferred examplary embodiment heating is discontinued after the water has been substantially vaporized. Then a light oil, such as kerosene, is mixed with the liquid remaining the amount of kerosene added being anywhere from 20 percent by weight to as high as 60 percent by weight, the preferred amount being approximately 30 percent to 50 percent by weight based on the weight of the light oil and the composition remaining in the heating zone.

After such mixing, the liquid is removed from the bottom of the tank by a faucet, or the like, the diameter of the opening of the faucet being preferably less than the size of the coke thereby usually separating the liquid from the solid coke. However, the light oil or kerosene can also be mixed after the liquid is separated from the solid coke, there being no criticality in mixing the kerosene with the other liquid in the presence of the coke. Additionally, it is believed to be self-apparent, that the liquid and solid coke can be separated in any convenient manner.

This liquid when transferred to another steel cyllindrical container having an opening at the top which is provided with a cover which, when in place, provides an airtight container.

After the liquid composition has been placed in the steel cyllindrical container the composition is ignited in any convenient manner and allowed to burn for a period of anywhere from as little as one-tenth of a minute upwards to two minutes and longer. The cover is then put on the container making the container airtight thus extinguishing the flame. The same procedure is then repeated, at least once, and up to as many as ten times or more times and the resulting liquid is then removed. This liquid is the prefuel composition mentioned heretofore.

Such prefuel composition, as is already been noted, is an excellent fuel by itself. However, it is of much greater value when this fuel is mixed with water and oil because the resulting composition renders almost as many btu's, on a weight basis, as fuel oil itself and/or the oil that is actually added to the prefuel composition.

The prefuel composition itself produces about 10,000 British thermal units (btu) per pound. When this prefuel composition is mixed with a fuel oil (having a btu content of about 20,000 btu's per pound) and water, it was found that a one-phase solution resulted which could be burned. For example, a 40 percent fuel oil, 30 percent prefuel composition, and 30 percent water were mixed, all percentages being by weight. Such a mixture gave approximately 19,394 btu's per pound. It would be expected that such a mixture would only give 11,000 btu's per pound since water has a zero value, the prefuel composition would have 3,000 btu's (i.e. one-third of a pound) and the fuel oil would have approximately 8,000 btu's (i.e. .4 pounds). Thus, not only does a uniform mixture result but such solution gives higher energy than would be expected.

The fuel compositions of the present invention, containing water, can vary in amounts greatly. For example, the amount of water is the composition can vary from zero percent (which would be uneconomical) and preferably 10 percent or 20 percent to as high as 40 or 50 percent, by weight. The amount of oil can also vary greatly ranging from 70 percent, by weight of oil (which would be uneconomical) to as little as 20 percent, with the preferred amount ranging from 20 or 30 percent to 60 percent. The prefuel composition, in the fuel composition, can range from 10 or 20 percent to as high as 40 or 50 percent.

Although in the presently preferred embodiment Bunker C. oil can be used and the weights and percentages can vary, be it understood that the presently preferred embodiment is merely illustrative of the present invention and the invention is not to be considered to be limited thereby.

I claim:

1. A method for producing a liquid prefuel composition which may be mixed with water and oil to form a uniform admixture as a fuel which comprises;

placing carbon, water and oil, having a specific gravity of less than one, into a heating zone having an opening to the atmosphere and forming a non-homogenous mixture composed of a liquid phase 10 percent to 50 percent by weight of water and, on top thereof, a liquid phase of 10 percent to 50 percent by weight oil with 10 percent to 50 percent, by weight carbon intermixed in both liquid phases;

heating said non-homogenous mixture to a temperature of from 50° to 100° C. to vaporize the water and bubble the water vapor through, and in intimate contact with, the oil;

discontinuing heating and adding from 20 percent to 60 percent, by weight, light oil to the remaining liquid in said non-homogenous mixture to form a homogenous mixture of the liquid oil and the liquid remaining in said non-homogenous mixture and separating said uniform mixture of liquids from the solid carbon;

burning said uniform mixture of liquids in the presence of oxygen and extinguishing same by removing the source of oxygen, and recovering the resulting prefuel liquid composition.

2. A method according to claim 1 wherein the heating in said heating zone is continued until at least 30 percent, by weight, of the water is removed.

3. A method according to claim 2 wherein the heating is continued in the heating zone until substantially all of the water is removed.

4. A method according to claim 1 wherein the carbon is coke.

5. A method according to claim 1 wherein the temperature at which said non-homogenous mixture is heated is from 70° to 100° C.

* * * * *